United States Patent [19]

Yen

[11] Patent Number: 4,916,985

[45] Date of Patent: Apr. 17, 1990

[54] APPARATUS FOR REMOVING A SOFT STOPPER FROM A CONTAINER

[76] Inventor: Richard C. K. Yen, 4261 Chase Ave., Los Angeles, Calif. 90066

[21] Appl. No.: 401,186

[22] Filed: Aug. 31, 1989

[51] Int. Cl.[4] ..... B67B 7/02

[52] U.S. Cl. ..... 81/3.45

[58] Field of Search ..... 81/3.45, 3.07, 3.48

[56] References Cited

U.S. PATENT DOCUMENTS 2,093,541 9/1937 Bohler ..... 81/3.45

4,574,662 3/1986 Jones ..... 81/3.45

*Primary Examiner*—Roscoe V. Parker

*Attorney, Agent, or Firm*—Thomas I. Rozsa

[57] ABSTRACT

An apparatus for removing a soft stopper such as a cork from a container such as a bottle. The apparatus includes a hollow cylinder having a slit along its length and a handle attached to the top of the cylinder. The interior surface of the cylinder includes a spiral wound thread having a flat upper surface. The cylinder is inserted between the outer circumference of the cork and the interior wall of the bottle and is rotated so that the threads are embedded in the outer wall of the cork and serve to compress the cork inwardly as the apparatus is screwed into the container. A stop ring serves to limit the penetration of the apparatus into the bottle and when the apparatus has reached its maximum penetration, the apparatus begins to force the cork out of the bottle as the turning motion of the cork continues. In an alternative embodiment, the cylinder includes a hinge which permits the two halves of the cylinder to be opened after the cork is removed from the bottle to thereby enable the cork to be removed from the opened cylinder.

22 Claims, 1 Drawing Sheet

Fig. 1.
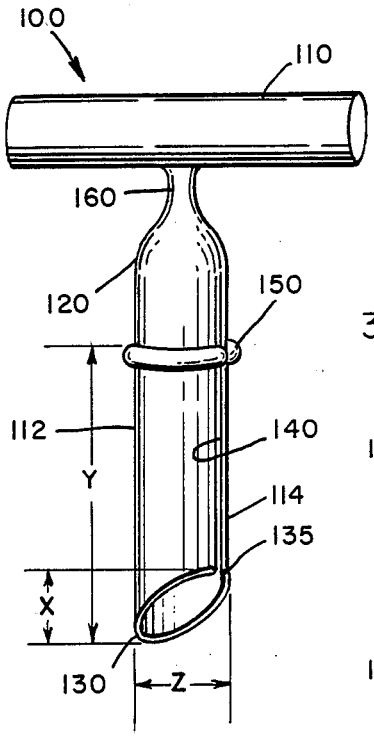
Fig. 2.
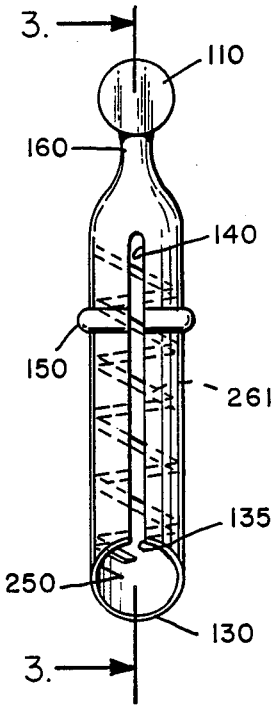
Fig. 3.
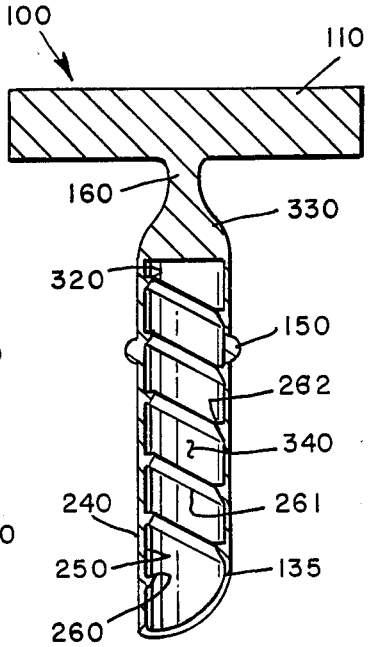
Fig. 4.
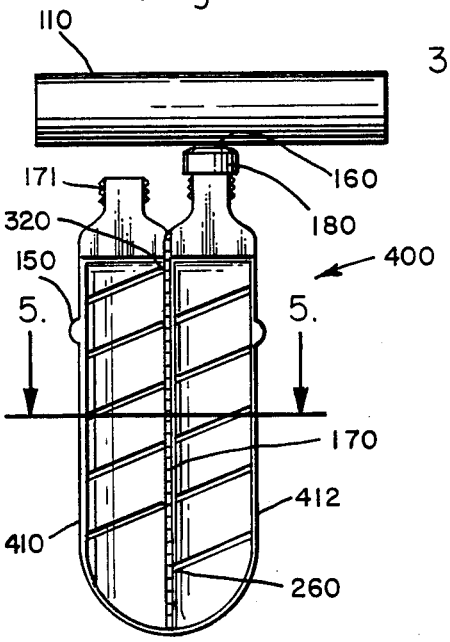
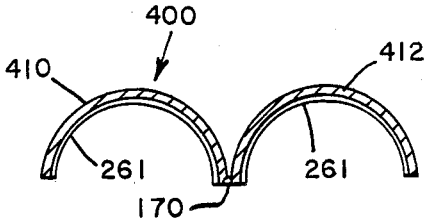
Fig. 5.

APPARATUS FOR REMOVING A SOFT STOPPER FROM A CONTAINER

BACKGROUND OF THE INVENTION

1. Field of the Invention

The present invention relates to apparatus which are used to remove a soft stopper such as the cork from a container such as a bottle of wine.

2. Description of the Prior Art

Many liquid containers have stoppers made of cork to prevent spillage during transportation and to preserve the liquid contents during prolonged storage. For example, alcoholic beverages such as wines are often stored in long neck glass bottles which allows the wine to breathe and sometimes adds flavor to the wine. To remove the cork, typically a corkscrew is used to bore a hole in the middle of the cork to be pulled out of the bottle neck. However, there are many disadvantages to the conventional corkscrew and there exists a need for a safe and effective tool to grip the cork for removal from a bottle.

The typical corkscrew consists of a long solid screw which is connected to a handle usually arranged perpendicular to the longitudinal axis of the screw to facilitate the rotational effort by the user's hand in screwing the screw into the cork and for pulling the cork out of the bottle.

Several disadvantages of prior art corkscrews are as follows:

(1) The screw has a distinct sharp point which can easily puncture or lacerate the user or another person;

(2) There is no structural design to assist the screw to center itself so as not to puncture one side of the cork before the entire longitudinal length of the cork is transversed for maximum friction between the cork and the screw. There is also no structural design to insure that once the top of the cork is punctured, (whether at the center of the top surface of the cork or not), that the direction of penetration is parallel to the central longitudinal axis. The screw is particularly prone to travel in several different directions if the user cannot steady his or her hand at all times during the screwing motion. When this happens, the cork is particularly prone to breakage;

(3) Even if the center is punctured and the subsequent direction of the screw is exactly along the longitudinal axis of the cork, some corks are so soft that on pulling, the center of the cork disintegrates and allows the screw to come out of the cork without the cork being pulled out of the bottle neck;

(4) Once the cork has a complete bore in the center, there is no way another attempt with the same screw will succeed in removal of the cork because the threads of the screw no longer can form any tight contact and friction with the body of the cork. To retrieve the liquid, one has to either push the broken cork into the bottle or break the glass container itself, both methods introducing contaminants into the wine;

(5) The major obstacle to the removal of the cork is the friction between the cylindrical surface of the cork and the interior of the bottle neck surrounding the cork. To attempt to overcome this friction by using the friction between a narrow straight slippery metal screw at the center of the cork, in loose contact with the body of a soft screw, is a most ineffective approach. This approach tends to break the cork rather than overcome the friction between the cork and the bottle neck.

Therefore, there is a significant need for an improved cork removal apparatus which overcomes the disadvantages of the prior art corkscrews.

SUMMARY OF THE PRESENT INVENTION

The present invention is an apparatus for removing a soft stopper such as a cork or rubber stopper from a container which operates by gripping the cork from the circumferential surface toward the center. Through this process, a continuous centering and stabilizing mechanism is provided which allows less tiring effort and skill from the user. Through use of the present invention, the integrity of the cork is preserved while it is being pulled out of the bottle neck. The present invention also does not create any holes inside the body of the cork as caused by conventional corkscrews. This tool is not sharp and the threads of the gripping mechanism are directed inward and hidden from the user, whereby the user cannot harm himself. The unsymmetrical design of the cross-sectional area of the gripping mechanism allows easy insertion of the tool but maximum friction with the cork while it is being pulled out. The tool shears the cork from the interior surface of the bottle neck, attacking the areas where most friction occurs, thus facilitating removal of the cork.

The invention is new and unique because it can be used on corks, or other soft stoppers that are new and untouched as well as on corks that have been damaged by conventional corkscrews, with a hole in the center that is coming apart. No other tools, including the conventional corkscrew, are designed to pull out damaged corks as well as new corks.

It has been discovered, according to the present invention, that the use of a cylindrical object whose diameter is slightly larger that the diameter of a cork, or other soft stopper and which contains threads on its interior surface enables the apparatus to be inserted between the exterior surface of the cork, or other soft stopper and the adjacent interior surface of the container into which the cork has been embedded, thereby creating a cork removal apparatus which removes the cork by the force of the internal threads compressing the cork and driving it out of the container, as opposed to puncturing the cork.

It has further been discovered, according to the present invention, that the use of a cylindrical object whose diameter is slightly larger that the diameter of a cork, or other soft stopper and which contains threads on its interior surface enables the apparatus to compress the cork while removing it, thereby enabling the user to utilize the present invention with corks that have been damaged and sheared in addition to new corks.

It has additionally been discovered, according to the present invention, that the use of a hinge along the length of the cylindrical object enables the object to be opened to thereby facilitate removal of the cork after it has been pulled from the bottle.

It is therefore an object of the present invention to provide a cork, or other soft stopper removal apparatus which grips the cork from the exterior surface and squeezes it inwardly, thereby resulting in a compressive force on the cork. This enables the cork to be removed even if it is damaged because of the compressive force instead of the puncturing operation created by conventional cork removal corkscrews.

It is another object of the present invention to provide a cork, or other soft stopper removal apparatus which eliminates the sharp point of conventional corkscrews, thereby substantially reducing the likelihood of injury to the user.

It is a further object of the present invention to provide a cork, or other soft stopper removal apparatus which stabilizes the cork as it is removed from its container, thereby reducing the likelihood that the cork will break apart during removal.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a side elevational view of the preferred embodiment of the present invention apparatus for removing a cork, or other soft stopper from a container.

FIG. 2 is a rear elevational view of the preferred embodiment of the present invention apparatus for removing a cork, or other soft stopper from a container.

FIG. 3 is a cross-sectional view taken along line 3—3.

FIG. 4 is a side-elevational view of an alternative embodiment of the present invention apparatus for removing a cork, or other soft stopper from a container, in the opened position.

FIG. 5 is a cross-sectional view taken along line 5—5 of FIG. 4.

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Referring particularly to FIG. 1, the present invention apparatus for removing a cork from a container 100 comprises a handle or hand gripping means 110 connected through a throat member 160 to a hollow cylindrical structure 120. The hollow cylindrical structure 120 has a longer side 112 and a shorter side 114. The shorter side 114 further comprises a longitudinal slit 140. By way of example, the overall length of the apparatus 100 may be approximately 12 centimeters and the width of slit 140 may be approximately 0.2 centimeters. The wall of the cylinder 120 should be thin, for example approximately 0.1 centimeter or less and made of sturdy material such as strong plastic or metal. As illustrated in FIG. 1, the longer side 112 of the cylinder 120 exceeds the shorter side 114 by a distance "X" which by way an example can be approximately 1 centimeter. This allows the tip 130 of the cylinder 120 to be pushed into the area between the circumferential surface of the cork and the interior of the bottle for the purpose of steadying the tool and aligning the center of the hollow cylinder 120 with the center of the cork in a direction parallel to the longitudinal axis of the cork. The external diameter of the cylinder 120 is z (which by way of example may be approximately 2 centimeters). The slit 140 allows the cylinder 120 to open up upon insertion of the tip 130 to wedge part of the cork away from the bottleneck and to permit the tool to grip corks which are slightly larger than 2 cm in diameter. If the corks are smaller in diameter than 2 cm, upon insertion of tip 130 to the contact area between the cork and the bottle neck, the cylinder 120 will also accommodate itself to this smaller cork.

For ease of insertion into the area between the external circumferential surface of the stopper and the interior surface of the container neck, the tip 130 is tapered, with the sharp edge near the external surface of the apparatus. Similarly, the edges of the apparatus forming slit 140 along the entire length of the slit are tapered with the sharp edges near the external surface of the apparatus.

The cylinder 120 also has a broken ring 150 which is broken at the location of the slit 140 to thereby allow the slit 140 to continue uninterrupted. The broken ring 150 is fixed on the outer surface of the cylinder 120 at a distance of Y from the tip of the cylinder 130. By way of example, the distance Y may be approximately 4 centimeters. This ring should be made of hard material which has minimal friction with glass or the material making the top surface of the bottle neck. Other fancy structures such as ball bearings can be fitted here as additional ways to decrease friction between the tool and the top surface of the container which surrounds the cork.

Referring to FIGS. 2 and 3, the interior surface 250 of the cylinder 120 further comprises a spiral wound thread formed into it and extending into the interior space of the cylinder 120. As illustrated in FIG. 3, the spiral thread 261 starts at the level 260 which is at the level of the short length 135 of cylinder 120 and continuous up the interior surface 250 towards the connecting throat 160 which is narrower than the cylinder 120 to allow a firm and comfortable grip of the handle 110. The spiral direction of the threads 261 can be right-handed or left-handed to suit both types of users.

Referring to FIG. 3, it can be seen that the wedge near the tip 130 of the longer length of the cylinder 120 and the tip 135 of the shorter length of the cylinder are designed such that the outer surface 240 of the cylinder 120 is straight and the inner surface 250 is tapered to squeeze the cork toward its own center. The squeezing of the cork preserves the intactness of the cork so that no broken pieces fall inside the container and also increases the friction applied onto the cylindrical surface of the cork. The lower end 260 of the thread 261 starts at the level of 135 and winds it way up to 320 which is about 2 centimeters beyond the level of the ring 150. As illustrated in FIG. 3, the threads 261 are not symmetrical in cross-section but flat on the top surface 262 to exert maximum pulling force on the cork to twist it upwards.

After the insertion of the tip of the cylinder to wedge between the cork and the bottle neck, initial turning motions of the apparatus 100 will bring the apparatus 100 down in a direction toward the bottom of the container. After about 4 centimeters penetration, the broken ring 150 will not allow the cylinder 120 to move further down toward the bottom of the container. As the apparatus 100 is screwed into the bottle, the threads 261 are screwed into the exterior surface of the cork.

After the apparatus 100 has been screwed into the bottle to its maximum penetration (when the broken ring 150 reaches the top of the container), further continuous turning motion of the cylinder 120 in the same direction will instead twist the cork upwards in a direction away from the bottom of the container because the flat upper surface 262 of threads 261 will cause the cork to be moved upwardly out of the container. This will allow the cork to be removed from the bottle or container neck without the right-handed user physically holding with the left hand onto the bottle or container and trying with the right hand to pull the cork from the bottle or container. The left hand merely steadies the bottle or container while the right hand turns the apparatus, always in the same direction, which is easier to perform and prevents breaking the glass container. The connection between the handle 110 and the cylinder 120 at 160 should not be thicker than 1 centimeter to allow a comfortable grip between the user's second and third fingers while the hand is holding the handle 110.

As the top of the cork moves from 135 toward 320, the bottom of the cork also moves away from 135 towards 320. The distance between 135 and 320 should be such that when the top of the cork reaches 320, the bottom of the cork is so far away from 135 that the lower part of the cylinder 120 can easily be slid out from the bottle neck. The shaded area of 330 represents solid material, in contrast to the hollow interior 340 of the cylinder 120.

The preferred embodiment of the present invention as discussed above is meant to be a disposable one-time apparatus because the cork will stay inside the hollow cylinder 120. Another cork will have to be supplied to serve as a stopper if the liquid is not completely used up and needs to be further stored.

The preferred embodiment can therefore be defined as an apparatus for removing a cork from a container, comprising: (a) a thin walled hollow generally cylindrical body having a first side which is longer than its opposite second side thereby terminating in a bottom extending at an upward angle from the lower tip of the first side to the lower tip of the second side; (b) the top of the thin walled hollow generally cylindrical body extending into a neck member whose diameter is narrower than the diameter of said thin walled hollow generally cylindrical body; (c) a transverse handle member attached to said neck member at a location remote from the top of the thin walled hollow generally cylindrical body; (d) a longitudinal slit in the wall of said thin walled hollow generally cylindrical body extending from the lower tip of the second side for most of the length of the body; (e) a fixed broken ring extending around the circumference of said thin walled hollow generally cylindrical body at a location remote from the bottom of the body, the break in the ring aligned with the longitudinal slit in the wall of the thin walled hollow generally cylindrical body; and (f) an inwardly extending spiral thread extending from the interior surface of said thin walled hollow generally cylindrical body and winding from the bottom of the body upwardly beyond the location of said broken ring.

The wall of said thin walled hollow generally cylindrical body is inwardly tapered adjacent its bottom.

The inwardly extending spiral thread further comprises a flat upper surface.

The alternative embodiment of the present invention is illustrated in FIG. 4. In the alternative apparatus 400, the cork can be removed intact and reused. All of the features discussed in the preferred embodiment apparatus 100 are also present in the alternative embodiment apparatus 400. Therefore, the parts are numbered the same. There are two modifications which differentiate the alternative apparatus 400. The first modification is the addition of a hinge 170 which is located along the length of the cylinder 120 at a location exactly opposite to the slit 140. The second modification is the addition of moveable collar 180 which fits tightly onto the connecting neck 160 and threaded thereon through threads 171. As illustrated in FIG. 4, the alternative apparatus is divided into two halves 410 and 412 which can be separated into the opened position by the hinge 170. For the operation of removing the cork from the bottleneck, the two halves 410 and 412 are placed together so that the alternative apparatus 400 resembles the preferred embodiment apparatus 100 as illustrated in FIG. 1 and the collar 180 will be in the down, tight fitting position, so that the two halves along the hinge (410, 412 respectively) will form a hollow cylinder with a narrow slit 140. After removal of the cork from the bottleneck as previously described, the cork will have moved into the interior of the cylinder 120. To retrieve the cork, the collar 180 will be slid upwards, to allow the two halves of the cylinder wall, 410 and 412 to open up and expose the cork, which can now be picked up easily from the opened cylinder. The hinge should ideally be thin and unobstructive to the rotational movement of the cylinder during removal of the cork from the bottle neck. Ideally, if the tool is made of hard plastic, the hinge will represent a thinned out area in the shape of a narrow line which is flexible and durable without breakage even after multiple bending and flexing. During operation, the tight fitness between the cork and the bottle neck will prevent excessive wobbling of the hinge and thus protect it from tearing easily.

In summary, the present invention is an apparatus for removing a cork, or other soft stopper from a container such as a bottle. The apparatus includes a hollow cylinder having a split along its length and a handle attached to the top of the cylinder. The interior surface of the cylinder includes a spiral wound thread having a flat upper surface. The cylinder is inserted between the outer circumference of the cork and the interior wall of the bottle and is rotated so that the threads are embedded in the outer wall of the cork, or other soft stopper and serve to compress the cork inwardly as the apparatus is screwed into the container. A stop ring serves to limit the penetration of the apparatus into the bottle and when the apparatus has reached its maximum penetration, the apparatus begins to force the cork out of the bottle as the turning motion of the cork continues in the same direction. In an alternative embodiment, the cylinder includes a hinge which permits the two halves of the cylinder to be opened after the cork is removed from the bottle to thereby enable the cork to be removed from the opened cylinder.

The alternative embodiment of the present invention can be defined as an apparatus for removing a cork, or other soft stopper from a container, comprising: (a) a two piece thin walled hollow generally cylindrical body longitudinally divided in half and each half connected by a hinge forming a generally cylindrical shape when the two halves are placed together; (b) said two piece thin walled hollow generally cylindrical body having a first side which is longer than its opposite second side thereby terminating in a bottom extending at an upward angle from the lower tip of the first side to the lower tip of the second side; (c) the top of the two piece thin walled hollow generally cylindrical body extending into a neck member whose diameter is narrower than the diameter of said two piece thin hollow generally cylindrical body; (d) a transverse handle member attached to said neck member at a location remote from the top of the two piece thin walled hollow generally cylindrical body; (e) a longitudinal slit in the wall of said two piece thin walled hollow generally cylindrical body extending from the lower tip of the second side for most of the length of the body; (f) a longitudinal hinge in the wall of said two piece thin walled hollow generally cylindrical body extending from the lower tip of the first side for the entire length of the body to enable the two pieces to be rotated relative to one another by the longitudinal hinge; (g) a fixed broken ring extending around the circumference of said two piece thin walled hollow generally cylindrical body at a location remote from the bottom of the body, one break in the ring aligned with the longitudinal slit in the wall of the two piece thin walled hollow generally cylindrical body and a second break in the ring to allow opening of the two pieces along said longitudinal hinge; (h) a slidable collar located on said neck member for retaining the two halves of the two piece thin walled hollow generally cylindrical body together; and (i) an inwardly extending spiral thread extending from the interior surface of said two piece thin walled hollow generally cylindrical body and winding from the bottom of the body upwardly beyond the location of said broken ring.

Of course, the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms of modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. An apparatus for removing a soft stopper from a container, comprising:

a. a thin walled hollow generally cylindrical body having a first side which is longer than its opposite second side thereby terminating in a bottom extending at an upward angle from the lower tip of the first side to the lower tip of the second side;

b. the top of the thin walled hollow generally cylindrical body extending into a neck member whose diameter is narrower than the diameter of said thin walled hollow generally cylindrical body;

c. a transverse handle member attached to said neck member at a location remote from the top of the thin walled hollow generally cylindrical body;

d. a longitudinal slit in the wall of said thin walled hollow generally cylindrical body extending from the lower tip of the second side for most of the length of the body;

e. a fixed broken ring extending around the circumference of said thin walled hollow generally cylindrical body at a location remote from the bottom of the body, the break in the ring aligned with the longitudinal slit in the wall of the thin walled hollow generally cylindrical body; and f. an inwardly extending spiral thread extending from the interior surface of said thin walled hollow generally cylindrical body and winding from the bottom of the body upwardly beyond the location of said broken ring.

2. An apparatus for removing a soft stopper from a container in accordance with claim 1 wherein the wall of said thin walled hollow generally cylindrical body is inwardly tapered adjacent its bottom and along the slit along its longitudinal length of the apparatus.

3. An apparatus for removing a soft stopper from a container in accordance with claim 1 wherein said inwardly extending spiral thread further comprises a flat upper surface.

4. An apparatus for removing a soft stopper from a container in accordance with claim 1 wherein the outer diameter of said thin walled hollow generally cylindrical body is approximately 2 centimeters.

5. An apparatus for removing a soft stopper from a container in accordance with claim 1 wherein the longitudinal distance between the lower tip of the first side and the lower tip of the second side of said thin walled hollow generally cylindrical body is approximately 1 centimeter.

6. An apparatus for removing a soft stopper from a container in accordance with claim 1 wherein the longitudinal distance between the lower tip of the first side of said thin walled hollow generally cylindrical body and the location of said broken ring is approximately 4 centimeters.

7. An apparatus for removing a soft stopper from a container in accordance with claim 1 wherein the thickness of the wall of said thin walled hollow generally cylindrical body is approximately 0.1 centimeter.

8. An apparatus for removing a soft stopper from a container in accordance with claim 1 wherein the apparatus is made of plastic.

9. An apparatus for removing a soft stopper from a container in accordance with claim 1 wherein the apparatus is made of metal.

10. An apparatus for removing a soft stopper from a container in accordance with claim 1 wherein the spiral thread is a right handed thread.

11. An apparatus for removing a soft stopper from a container in accordance with claim 1 wherein the spiral thread is a left handed thread.

12. An apparatus for removing a soft stopper from a container, comprising:

a. a thin walled hollow generally cylindrical body having a first side which is longer than its opposite second side thereby terminating in a bottom extending at an upward angle from the lower tip of the first side to the lower tip of the second side;

b. hand-gripping means attached to the top of said thin walled hollow generally cylindrical body;

c. a longitudinal slit in the wall of said thin walled hollow generally cylindrical body extending from the lower tip of the second side for most of the length of the body;

d. a fixed broken ring extending around the circumference of said thin walled hollow generally cylindrical body at a location remote from the bottom of the body, the break in the ring aligned with the longitudinal slit in the wall of the thin walled hollow generally cylindrical body; and e. an inwardly extending spiral thread extending from the interior surface of said thin walled hollow generally cylindrical body and winding from the bottom of the body upwardly beyond the location of said broken ring.

13. An apparatus for removing a soft stopper from a container in accordance with claim 12 wherein said hand-gripping means further comprises:

a. a neck member attached to the top of said thin walled hollow generally cylindrical body, the throat having a diameter that is narrower than the diameter of said thin walled hollow generally cylindrical body; and b. a transverse handle member attached to said neck member.

14. An apparatus for removing a soft stopper from a container, comprising:

a. a two piece thin walled hollow generally cylindrical body longitudinally divided in half and forming a generally cylindrical shape when the two halves are placed together;

b. said two piece thin walled hollow generally cylindrical body having a first side which is longer than its opposite second side thereby terminating in a bottom extending at an upward angle from the lower tip of the first side to the lower tip of the second side;

c. the top of the two piece thin walled hollow generally cylindrical body extending into a neck member whose diameter is narrower than the diameter of said two piece thin hollow generally cylindrical body;

d. a transverse handle member attached to said neck member at a location remote from the top of the two piece thin walled hollow generally cylindrical body;

e. a longitudinal slit in the wall of said two piece thin walled hollow generally cylindrical body extending from the lower tip of the second side for most of the length of the body;

f. a longitudinal hinge in the wall of said two piece thin walled hollow generally cylindrical body extending from the lower tip of the first side for the entire length of the body to enable the two pieces to be rotated relative to one another by the longitudinal hinge;

g. a fixed broken ring extending around the circumference of said two piece thin walled hollow generally cylindrical body at a location remote from the bottom of the body, one break in the ring aligned with the longitudinal slit in the wall of the two piece thin walled hollow generally cylindrical body and a second break in the ring near the hinge to allow the opening of the two halves along said longitudinal hinge;

h. a slidable collar located on said neck member for retaining the two halves of the two piece thin walled hollow generally cylindrical body together; and i. an inwardly extending spiral thread extending from the interior surface of said two piece thin walled hollow generally cylindrical body and winding from the bottom of the body upwardly beyond the location of said broken ring.

15. An apparatus for removing a soft stopper from a container in accordance with claim 14 wherein the wall of said two piece thin walled hollow generally cylindrical body is inwardly tapered adjacent its bottom and along the slit along the longitudinal length of the apparatus.

16. An apparatus for removing a soft stopper from a container in accordance with claim 14 wherein said inwardly extending spiral thread further comprises a flat upper surface.

17. An apparatus for removing a soft stopper from a container in accordance with claim 14 wherein the outer diameter of said two piece thin walled hollow generally cylindrical body is approximately 2 centimeters.

18. An apparatus for removing a soft stopper from a container in accordance with claim 14 wherein the longitudinal distance between the lower tip of the first side and the lower tip of the second side of said two piece thin walled hollow generally cylindrical body is approximately 1 centimeters.

19. An apparatus for removing a soft stopper from a container in accordance with claim 14 wherein the longitudinal distance between the lower tip of the first side of said two piece thin walled hollow generally cylindrical body and the location of said broken ring is approximately 4 centimeters.

20. An apparatus for removing a soft stopper from a container in accordance with claim 14 wherein the thickness of the wall of said two piece thin walled hollow generally cylindrical body is approximately 0.1 centimeter.

21. An apparatus for removing a soft stopper from a container in accordance with claim 14 wherein the apparatus is made of plastic.

22. An apparatus for removing a soft stopper from a container in accordance with claim 14 wherein the apparatus is made of metal.

* * * * *